US011289797B2

(12) United States Patent
Wang et al.

(10) Patent No.: US 11,289,797 B2
(45) Date of Patent: Mar. 29, 2022

(54) ELECTRONIC DEVICE

(71) Applicant: Lenovo (Beijing) Co., Ltd., Beijing (CN)

(72) Inventors: Wei Wang, Beijing (CN); Jian Ren, Beijing (CN); Zhiyuan Duan, Beijing (CN); Shuangjie Wu, Beijing (CN)

(73) Assignee: LENOVO (BEIJING) CO., LTD., Beijing (CN)

( * ) Notice: Subject to any disclaimer, the term of this patent is extended or adjusted under 35 U.S.C. 154(b) by 77 days.

(21) Appl. No.: 16/581,731

(22) Filed: Sep. 24, 2019

(65) Prior Publication Data

US 2020/0106165 A1 Apr. 2, 2020

(30) Foreign Application Priority Data

Sep. 30, 2018 (CN) ..... 201811162945.8

(51) Int. Cl.

| | |
|---|---|
| ***H01Q 1/24*** | (2006.01) |
| ***H01Q 21/06*** | (2006.01) |
| ***H01Q 5/50*** | (2015.01) |
| ***H01Q 13/10*** | (2006.01) |

(52) U.S. Cl.

CPC ..... *H01Q 1/243* (2013.01); *H01Q 1/24* (2013.01); *H01Q 5/50* (2015.01); *H01Q 13/10* (2013.01); *H01Q 21/06* (2013.01); *H01Q 21/064* (2013.01)

(58) Field of Classification Search

CPC ..... H01Q 1/243; H01Q 13/10; H01Q 5/50; H01Q 21/064; H01Q 1/24; H01Q 21/06; H01Q 5/40; H01Q 1/2258; H01Q 1/242; H01Q 1/44

USPC ..... 343/770

See application file for complete search history.

(56) References Cited

U.S. PATENT DOCUMENTS

| | | | | |
|---|---|---|---|---|
| 2013/0088397 | A1 | 4/2013 | Mo et al. | |
| 2014/0218250 | A1* | 8/2014 | Kim | H01Q 13/106 343/767 |
| 2016/0049734 | A1* | 2/2016 | Kim | H01Q 21/28 343/702 |
| 2017/0331807 | A1* | 11/2017 | Mont-Reynaud | H04W 12/06 |
| 2018/0069293 | A1* | 3/2018 | Hu | H01Q 1/243 |
| 2018/0138578 | A1* | 5/2018 | Chiang | H01Q 9/42 |
| 2019/0013569 | A1* | 1/2019 | Han | H01Q 1/50 |
| 2019/0097314 | A1* | 3/2019 | Rajagopalan | H01Q 1/521 |
| 2020/0073445 | A1* | 3/2020 | Kuna | H01Q 1/2258 |

FOREIGN PATENT DOCUMENTS

| | | | |
|---|---|---|---|
| CN | 204538197 | U | 8/2015 |
| CN | 105609969 | A | 5/2016 |
| CN | 105655701 | A | 6/2016 |
| CN | 205595453 | U | 9/2016 |
| CN | 106876897 | A | 6/2017 |
| CN | 106972256 | A | 7/2017 |
| CN | 207233948 | U | 4/2018 |
| CN | 108288749 | A | 7/2018 |

* cited by examiner

*Primary Examiner* — Hai V Tran

(74) *Attorney, Agent, or Firm* — Anova Law Group, PLLC

(57) ABSTRACT

The present disclosure provides an electronic device including: a metal housing having four antenna slots, which correspond to four antennas that enable the electronic device to support a fifth generation mobile communication network. The present disclosure can realize antennas that enable an electronic device having a metal back housing to support a fifth generation mobile communication network.

14 Claims, 6 Drawing Sheets

ELECTRONIC DEVICE

CROSS-REFERENCES TO RELATED APPLICATIONS

This application claims the priority of Chinese Patent Application No. 201811162945.8, filed on Sep. 30, 2018, the entire content of which is incorporated herein by reference.

FIELD OF THE DISCLOSURE

The present disclosure generally relates to the field of communications technologies and, more particularly, relates to an electronic device.

BACKGROUND

To enable an electronic device to support a 5th Generation (5G) technology to receive and transmit signals, an antenna supporting 5G frequency bands needs to be disposed on the electronic device. The 5G frequency bands are divided into two frequency bands: below 6 GHz (commonly known as sub-6 GHZ) band and millimeter wave band. Due to space limitation in an electronic device, an antenna made by Laser-Direct-structuring (LDS) technology is mainly used in an electronic device supporting the sub-6 GHZ band of the 5G technology.

The antenna made by LDS technology is to form a metal antenna on a molded plastic bracket by using laser technology, to laser an antenna to a backplane or a housing of the electronic device. By using LDS technology to form the antenna on the housing of the electronic device, internal space of the electronic device can be effectively utilized, but it is required to provide an antenna substrate for LDS in the electronic device, such as a plastic bracket of a special material, and an electronic device with a metal back housing cannot meet conditions for making a LDS antenna. Therefore, those skilled in the art need to design an antenna that has a wider range of applications and supports required frequency bands in the 5G technology.

BRIEF SUMMARY OF THE DISCLOSURE

One aspect of the present disclosure provides an electronic device including a metal housing, that the metal housing includes four antenna slots, and the four antenna slots correspond to four antennas that enable the electronic device to support a fifth generation mobile communication network.

Other aspects of the present disclosure can be understood by those skilled in the art in light of the description, the claims, and the drawings of the present disclosure.

BRIEF DESCRIPTION OF THE DRAWINGS

To more clearly illustrate the technical solution in the present disclosure, the accompanying drawings used in the description of the disclosed embodiments are briefly described hereinafter. Obviously, the drawings described below are merely some embodiments of the present disclosure. Other drawings may be derived from such drawings by a person with ordinary skill in the art without creative efforts and may be encompassed in the present disclosure.

DETAILED DESCRIPTION

Figure 1:
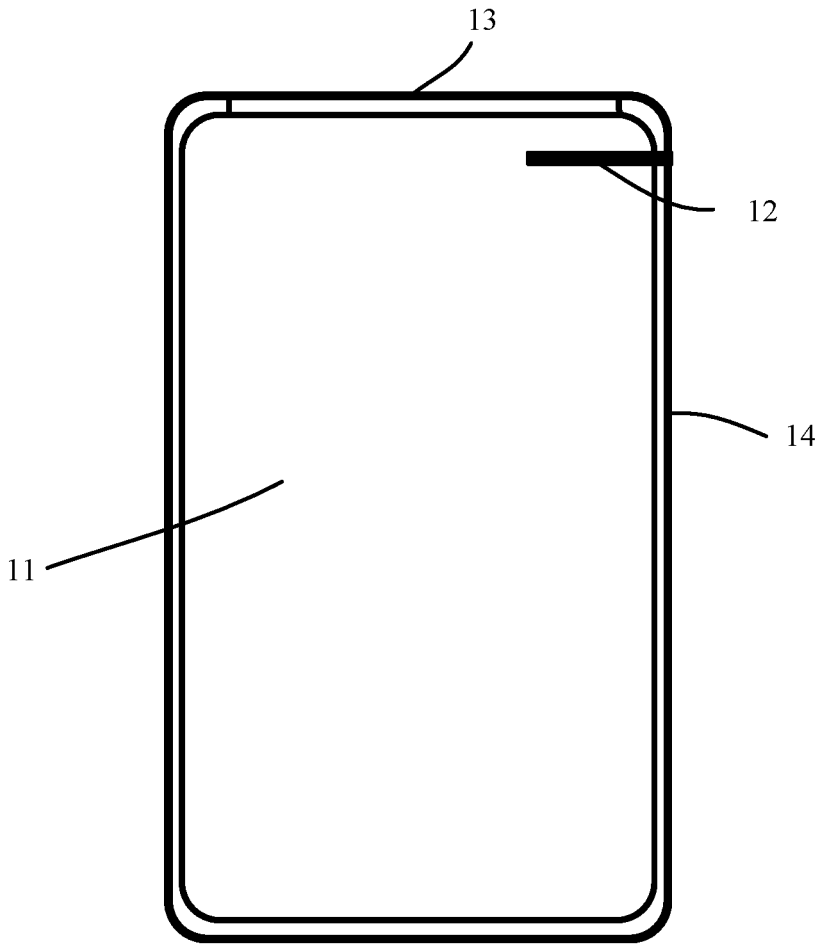
FIG. 1 is a schematic view showing antenna slots provided on a metal cover plate of an electronic device according to some embodiments of the present disclosure.

To make the foregoing objectives, features and advantages of the present disclosure clearer and more understandable, the present disclosure will be further described with reference to the accompanying drawings and embodiments. However, disclosed embodiments may be embodied in various forms and should not be construed as limited to the embodiments set forth herein. Rather, these embodiments are provided to fully convey the thorough and complete concepts of the disclosed embodiments to those skilled in the art.

The terms "first", "second", "third", "fourth", etc. (if present) in the specification and claims and the above figures are used to distinguish similar parts and are not necessarily used to describe specific order or sequence. The data so used may be interchanged where appropriate, so that embodiments of the present disclosure described herein can be implemented in a sequence other than that illustrated herein.

The solution of embodiments of the present disclosure is applied to an electronic device, and the electronic device may be a mobile terminal such as a mobile phone, a tablet computer, etc., or may be other electronic devices capable of supporting a wireless communication network.

In some embodiments of the present disclosure, the electronic device includes a metal housing, which may be a metal back cover of the electronic device or a part of the metal back cover.

The metal housing of the electronic device includes four antenna slots. The four antenna slots correspond to four antennas that enable the electronic device to support a fifth generation mobile communication network.

In some embodiments of the present disclosure, antennas supporting a fifth-generation mobile communication (5th-generation, 5G) network in the electronic device are disposed on the metal housing. For example, the antennas may be part of a metal body of the metal housing, or may be antenna bodies provided on the metal housing.

In some embodiments of the present disclosure, a frequency band supported by the four antennas supporting the 5G network in the electronic device may be any one of 5G frequency bands. Frequency bands in the 5G supported by the four antennas may be the same or different.

Optionally, the four antennas supporting the 5G network in the electronic device support a frequency band lower than 6 GHz in the 5G frequency bands. For example, each antenna supports 3.3 GHZ-5.0 GHZ in the 5G frequency bands. For another example, each antenna supports 3.3 GHZ-3.8 GHZ and 4.4 GHZ-5.0 GHZ in the 5G frequency bands.

Each antenna supporting the 5G network in the electronic device is connected to an antenna feeding network. Based on the antenna feeding network, a high-frequency oscillating current generated by the electronic device can be transmitted to an antenna through a feeder, and the high-frequency current is converted into a radio wave to be emitted through the antenna. A radio wave outside the electronic device is converted into a high-frequency current through the antenna and transmitted to the antenna feeding network to realize signal reception. Optionally, a wirelessly connected wireless feeding network can be disposed on a printed circuit board (PCB) within the electronic device.

Antenna slots corresponding to antennas supporting the 5G network of the electronic device are adjacent to the antennas corresponding to the antenna slots. For example, an antenna supporting the 5G network may surround an antenna slot; or, it may be surrounded by the antenna slot.

In some embodiments of the present disclosure, an antenna slot is a gap, so that metal in the metal housing around the antenna slot can be isolated through the antenna slot, so that receiving and transmitting radio waves of a frequency band corresponding to the 5G network can be realized through an antenna by disposing an antenna slot for each antenna.

Through a corresponding antenna slot on a metal housing of an electronic device for each antenna supporting the 5G network, each antenna of the electronic device is enabled to receive and transmit a frequency band of the 5G frequency bands.

For example, by providing a corresponding antenna slot for an antenna, electromagnetic waves generated by vibration of the antenna can be radiated to external space of the electronic device through the antenna slot, and electromagnetic waves external to the electronic device can be transmitted to the antenna through a gap of the antenna slot.

For another example, by providing a corresponding antenna slot for an antenna, the antenna can be isolated from the metal housing, so that the antenna can radiate a 5G signal as an independent antenna body and receive a 5G signal external to the electronic device. For example, an antenna can be made to be a monopole antenna by forming an antenna slot.

Optionally, to keep a flat overall appearance of the metal housing of the electronic device, the antenna slot may be filled with a non-metal dielectric material.

Optionally, the four antenna slots provided on the metal housing may be symmetric about a reference point, which may be a center of the metal housing, or the perpendicular bisector of housing sides of the metal housing.

In some embodiments of the present disclosure, four antenna slots are provided on a metal housing of an electronic device, and the four antenna slots correspond to four antennas that enable the electronic device to support a fifth generation mobile communication network. Thus, by providing the four antenna slots on the metal housing, the four antennas supporting the fifth generation mobile communication network of the electronic device have a function of receiving and transmitting the fifth generation mobile communication signal, thereby enabling an electronic device with a metal housing to also have the potential to support fifth-generation mobile communication networks.

Specific positions and shapes of antenna slots provided on a metal housing of the present disclosure can be various. The following are examples of several possible situations in which antenna slots are provided.

FIG. 1 shows one possible case of forming an antenna slot on a metal housing.

As shown in FIG. 1, the metal housing includes a metal cover plate 11, and one or more of four antenna slots formed on the metal housing of an electronic device are gaps on the metal cover plate. As shown in FIG. 1, a gap formed on the metal cover plate is antenna slot 12 formed on the metal cover plate.

Optionally, the antenna slot 12 formed on the metal cover plate may be filled with a non-metal dielectric material.

Since each antenna slot formed on the metal cover plate corresponds to an antenna supporting the 5G network in the electronic device, by forming a gap on the metal cover plate as an antenna slot, it actually realizes a role of a slot antenna. That is, a gap formed on the metal cover plate is used as an antenna slot, and an antenna corresponding to the antenna slot can convert high-frequency oscillating currents into electromagnetic waves of the 5G frequency band to outside through the gap of the antenna slot; the antenna can convert external electromagnetic waves into high frequency oscillating currents through the antenna slot and transmit them to a receiver in the electronic device.

In a case that a gap is formed on the metal cover plate as an antenna slot, an antenna that enable the electronic device to support the 5G network can be disposed around the antenna slot on the metal cover plate. Optionally, a metal surrounding the antenna slot on the metal cover plate may be used as an antenna corresponding to the antenna slot.

The number of gaps formed on a metal cover plate as antenna slots can be set as needed. For example, a metal housing may have three antenna slots as gaps formed on a metal cover plate.

As an alternative in a case that a metal housing includes a metal cover plate, to facilitate the design and improve the aesthetics of antenna slots on an electronic device, four antenna slots on the metal housing may have two or four antenna slots as antenna slots formed on the metal cover plate.

Figure 2:
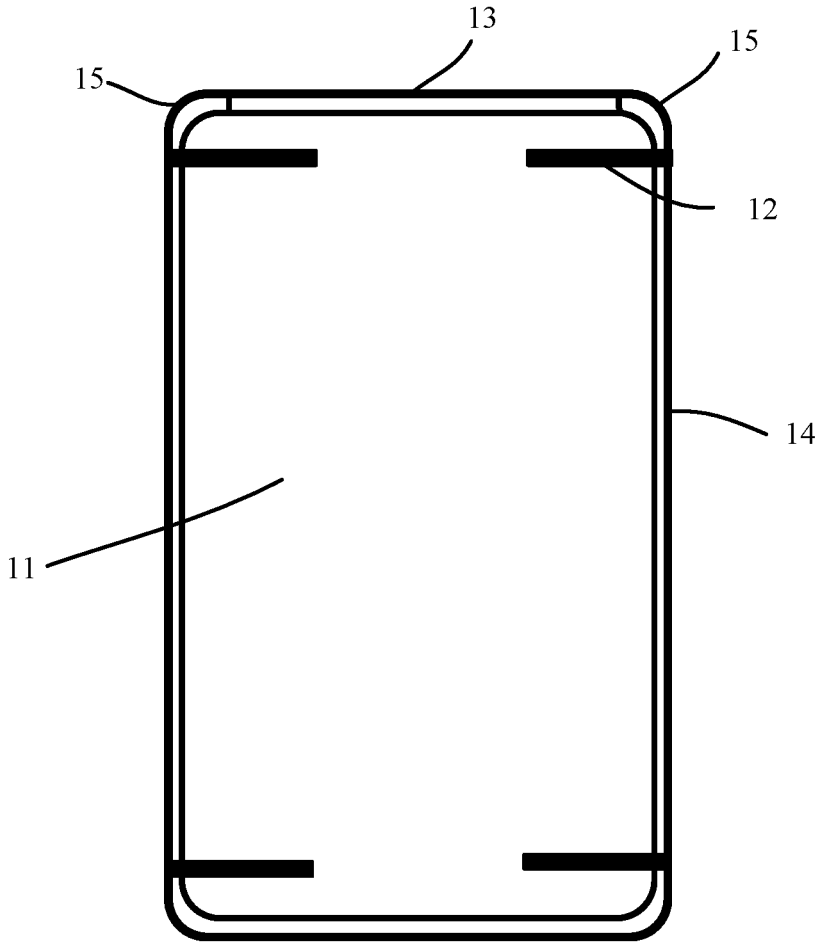
FIG. 2 is another schematic view showing antenna slots disposed on a metal cover plate of an electronic device according to some embodiments of the present disclosure.

FIG. 2 shows a schematic view of forming four antenna slots on a metal cover plate.

As shown in FIG. 2, four antenna slots 12 are formed on a metal cover plate 11, and each of the antenna slots is a gap formed on the metal cover plate.

In a case that four gaps are formed on a metal cover plate as four antenna slots, a metal housing is considered to be the metal cover plate.

Optionally, to achieve more stable radiation and reception of a wireless signal, an antenna slot formed on a metal housing may be a strip groove. As shown in FIGS. 1 and 2, the gaps on the metal cover plate are strip grooves. Correspondingly, the strip grooves are used for radiating the signal of the antennas corresponding to the strip grooves; or electromagnetic waves external to the electronic device are transmitted to the antennas corresponding to the strip grooves through the strip grooves.

In addition to setting an antenna supporting a 5G network, an electronic device may also be provided with an antenna supporting other networks, such as an antenna to support one or more of a second generation mobile communication 2G network, a third generation mobile communication 3G network, and a fourth generation mobile communication 4G network. Considering that a conventional arrangement of 2G, 3G, and 4G antennas on an electronic device is generally at a top side of a metal cover plate of the electronic device, to prevent antennas of other networks from being affected, and to keep a nice appearance, in some embodiments of the present disclosure, antenna slots (i.e., strip grooves) on the metal cover plate are disposed parallel to a first plate side of the metal cover plate.

As shown in FIG. 1 or 2, the metal cover plate includes two mutually parallel first plate sides 13 and two mutually parallel second plate sides 14, where the first plate sides 13 and the second plate sides 14 are vertical to each other, and a length of the first plate sides is less than a length of the second plate sides. The antenna slots 12 on the metal cover plate are parallel to the first plate sides, and a length of the antenna slots is smaller than the length of the first plate sides.

To reduce situations that antennas corresponding to antenna slots cannot receive and detect the 5G signal, due to the antenna slots of an electronic device are blocked in a process of a user holding the electronic device, in a case where two or more antenna slots are provided on a metal cover plate in some embodiments of the present disclosure, any two antenna slots or all of the antenna slots are symmetrical with respect to a reference point.

The reference point may be a center point of the metal cover plate, or the perpendicular bisector of a first plate side or a second plate side of the metal cover plate.

As shown in FIG. 2, in a case where the four antenna slots 12 are provided on the metal cover plate 11, the four antenna slots are symmetrical with respect to a center point of the metal cover plate. Any two antenna slots 12 on the metal cover plate 11 are symmetrical about the perpendicular bisector of the first plate sides 13 or the perpendicular bisector of the second plate sides 14.

FIG. 2 is an example in which four strip-shaped antenna slots are formed on the metal cover plate. If two strip-shaped antenna slots are provided on the metal cover plate, the two strip-shaped antenna slots can likewise be symmetrical about the perpendicular bisector of a first plate side or a second plate side.

For example, in FIG. 2, if two antenna slots disposed parallel to the first plate sides and disposed in an upper half region (or a lower half region) of the metal cover plate are reserved, it would be a schematic view of two strip-shaped antenna slots disposed on the metal cover plate, in which case the two antenna slots are on a same line parallel to the first plate sides and are symmetric about the perpendicular bisector of the first plate sides.

For another example, in FIG. 2, if two antenna slots parallel to the second plate sides and on a same side of a metal frame are reserved, it would be another schematic view of two strip-shaped antenna slots disposed on the metal cover plate, in which case the two antenna slots are symmetric about the perpendicular bisector of the second plate sides.

Optionally, in a case that antenna slots are symmetric about a reference point, a length of strip-shaped antenna slots is less than half of a length of the first plate sides, as shown by the antenna slot 12 in FIG. 1 or FIG. 2. In this way, two antenna slots can be avoided from being connected. As shown in FIG. 2, two antenna slots in an upper half of the metal cover plate are on a same straight line, but the two antenna slots are separated by the metal cover plate.

Further, to reduce situations that antenna slots of an electronic device are blocked in a process of a user holding the electronic device, antenna slots on a metal cover plate may be disposed in preset positions corresponding to four corners of the metal cover plate. When the number of the antenna slots on the metal cover plate is more than one, a plurality of antenna slots are distributed in preset positions corresponding to different corners of the metal cover plate.

Optionally, one end of antenna slots on the metal cover plate is on a second plate side of the metal cover plate. Optionally, in a case that two or more antenna slots are symmetrically arranged on the metal cover plate with respect to the perpendicular bisector of a second plate side, the two or more antenna slots symmetrically about the perpendicular bisector of the second plate side have one end located at a same second plate side, and the two or more antenna slots are respectively located at two ends of the same second plate side.

Each end of a second plate side may be adjacent to a position area of a side transition region of the second plate side, and the side transition region of the second plate side is a transition region connecting the second plate side and a first plate side. Two side transition regions 15 corresponding to each of the second plate sides 14 are indicated in FIG. 2.

As shown in FIG. 2, the four antenna slots 12 on the metal cover plate 11 are symmetric about a center point, and the four antenna slots 12 are distributed near four corners of the metal cover plate. On the metal cover plate 11, each of the second plate sides 14 is provided with two antenna slots 12 perpendicular to the second plate sides 14, so two strip-shaped antenna slots 12 are distributed on both sides of the perpendicular bisector of the first plate sides 13. Two antenna slots on either side of the perpendicular bisector of the first plate sides 13 are distributed at two ends of a second plate side, and the two ends of the second plate side are adjacent to two side transition regions 15 corresponding to the second plate side.

The antenna slots corresponding to the four antennas supporting the 5G network on the electronic device are symmetrically distributed to the metal cover plate by the distribution of the strip-shaped antenna slots shown in FIG. 2, so that four antennas corresponding to the four antenna slots are provided with good isolation, and in a process of a user holding the electronic device, a situation that the user's hand simultaneously blocks the four antenna slots is effectively avoided, thereby reducing situations that the electronic device cannot receive the signal because the antenna slots are blocked.

In some embodiments, a width of gaps for antenna slots formed on a metal cover plate can be set as needed.

In a case that an antenna slot is formed on a metal cover plate, an antenna corresponding to the antenna slot on the metal cover plate is also connected with an antenna feeding network supporting the 5G network. The antenna may be connected to a feeding point (also referred to as an antenna feed point or an antenna feeding point) through which the antenna is connected to the antenna feeding network.

Figure 3:
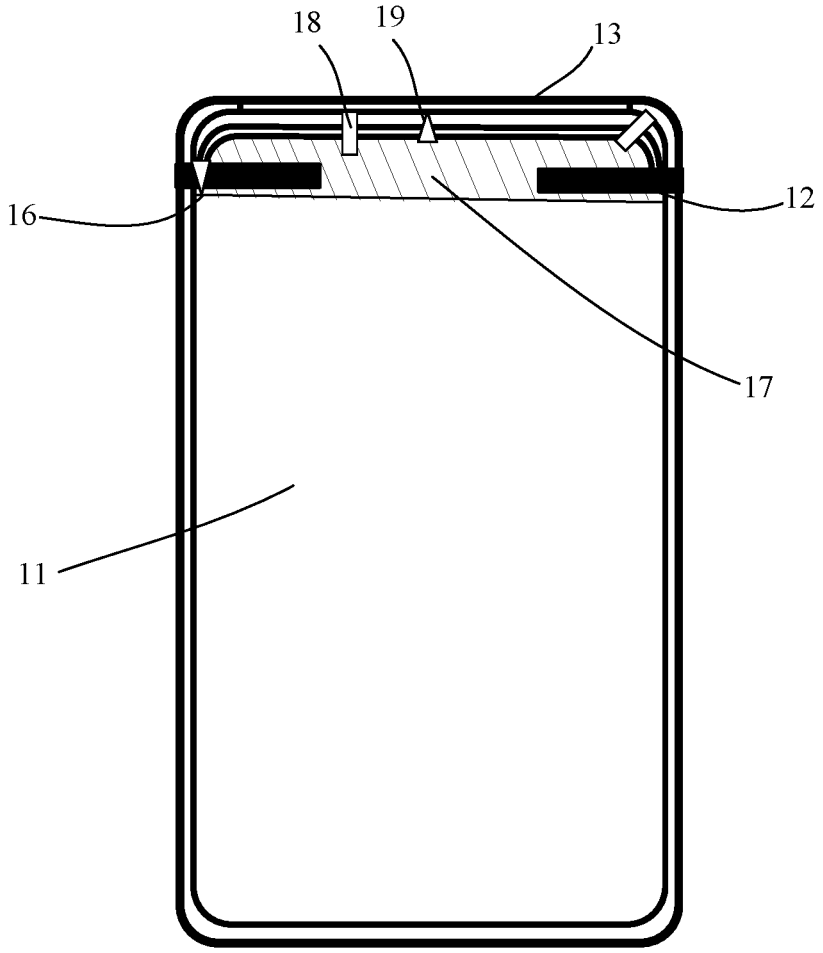
FIG. 3 is a schematic view showing inside of a metal cover plate of an electronic device according to some embodiments of the present disclosure.

The antenna feeding network is disposed on a printed circuit board, and the printed circuit board can be disposed inside the metal cover plate. An inside of the metal cover plate is a side of the metal cover plate facing the main body of the electronic device. For example, a back surface of the metal cover plate is shown in FIGS. 1 and 2, and another surface opposite to the back surface of the metal cover plate is an inner surface of the metal cover plate. FIG. 3 shows a schematic view of composition inside the metal cover plate.

As shown in FIG. 3, a gap as an antenna slot 12 formed on the metal cover plate can also be seen from inside of a metal cover plate 11. A metal side of the metal cover plate 11 adjacent to the antenna slot 12 is used as an antenna corresponding to the antenna slot to support the 5G network, and a feeding point 16 is provided at the metal side of the metal cover plate 11 adjacent to the antenna slot 12. As shown in FIG. 3, a feeding point 16 is disposed at each metal side used as an antenna corresponding to an antenna slot.

A feeding point is connected to an antenna feeding network on a printed circuit board. For example, the feeding point in FIG. 3 has an electrical connection with a printed circuit board 17 inside the metal cover plate. The printed circuit board is tiled at a top region of the metal cover plate.

FIG. 3 is only shown a schematic diagram of two antenna slots provided at a top end region of the metal cover plate. In a practical application, a bottom end region of the metal cover plate can also be provided with two symmetrical antenna slots, and its structure can be similar to the top end region of the metal cover plate shown in FIG. 3 and will not be described again.

To make the electronic device compatible with one or more of the 2G, 3G, and 4G networks, a first plate side at a top end region of a metal cover plate of the electronic device can be provided with antennas to support one or more of the 2G, 3G, and 4G networks. The first plate side at the top end region of the metal cover plate can also be provided with an antenna supporting WiFi and Global Positioning System (GPS).

For example, a gap can be formed in a region between a first plate side of a top end region and two second plate sides, and the first plate side of the top end region is used as an antenna supporting one or more of the 2G, 3G, and 4G networks. As shown in FIG. 3, a schematic view of inside the metal cover plate, a first plate side 13 at a top end region of the metal cover plate 11 is provided with a 4G feeding point 18, a 4G antenna tuning point 19, etc., connected to a printed circuit board.

In a case that total number of gaps as antenna slots on a metal cover plate is less than four, it is also possible to use other forms to form antenna slots in other parts of a metal housing. For example, the metal housing may include: a metal frame. Correspondingly, one or more of the four antenna slots formed on the metal housing are grooves located at sides of the metal frame.

The metal frame can be regarded as a metal frame on a back housing of an electronic device connected to a cover plate of the back housing and surrounding four plate sides of the cover plate. The metal frame is composed of four sides, and the four sides are two mutually parallel first sides and two mutually parallel second sides. A first side is perpendicular to a second side.

A groove formed on a side of the metal frame may be in various forms, for example, it may be a strip-shaped or a groove of other shapes.

Optionally, a groove for an antenna slot formed on a side of a metal frame is a U-shaped groove. For example, referring to FIG. 4, a schematic view of forming an antenna slot on a side of a metal frame is shown. Only a side view from the metal frame is shown in FIG. 4, and only a schematic view of an upper half of the metal frame is included in FIG. 4.

Figure 4:
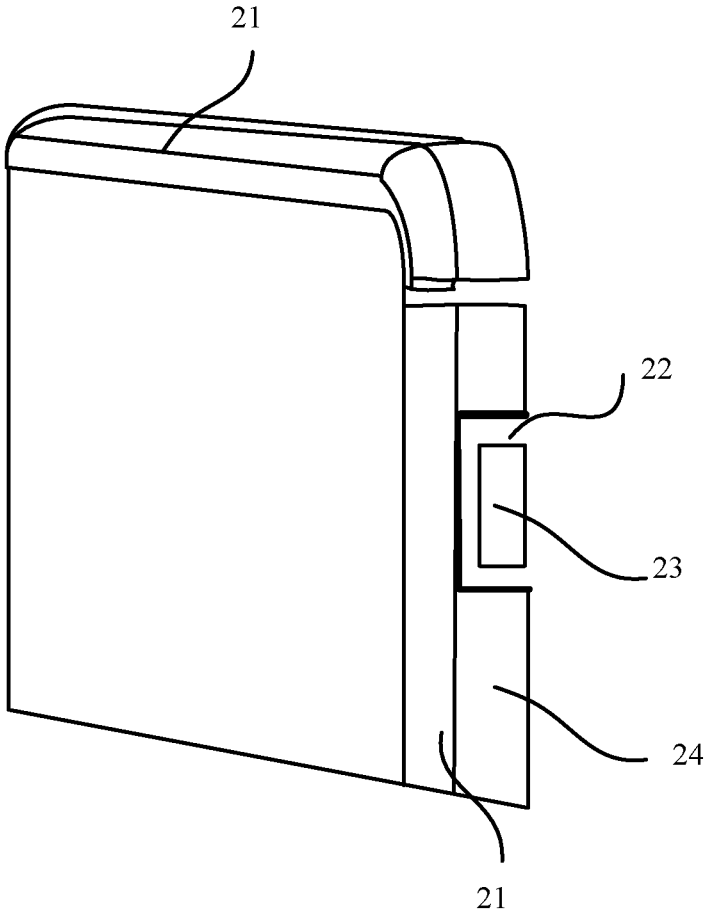
FIG. 4 is a schematic view showing antenna slots disposed on a metal frame of an electronic device according to some embodiments of the present disclosure.

As shown in FIG. 4, a U-shaped groove 22 is formed on a side of a metal frame 21.

Optionally, the U-shaped groove 22 can be used as a gap needed by an antenna corresponding to the U-shaped groove to transmit and receive a signal, that is, the U-shaped groove can be an antenna slot. In this case, the metal side not separated from the metal frame 21 and surrounding the U-shaped groove 22 may be provided as an antenna corresponding to the U-shaped groove for supporting a frequency band of the 5G network.

If the U-shaped groove is used as an antenna slot, an antenna corresponding to the U-shaped groove also needs to be connected to an antenna feeding network supporting the 5G network. For example, a feeding point is provided at the metal side as the antenna next to the U-shaped groove, and the feeding point is connected to an antenna feeding network in the electronic device. For details of connection between the feeding point on the antenna and the antenna feeding network, related description of previous embodiments can be referred to, and details are not described herein.

The principle of using a U-shaped groove as an antenna slot to support an antenna to receive and transmit signals is the same as the one of using a strip-shaped slot as an antenna slot, and is not described herein again.

In FIG. 4, an antenna groove which is an antenna slot on a side of the metal frame is a U-shaped groove. When the antenna slot formed on the side of the metal frame is in other shape, it is also applicable.

Optionally, the U-shaped groove separates the side of the metal frame into a metal piece isolated from the metal frame, and the metal piece is a radiator for implementing an antenna supporting the fifth generation mobile communication network. In this case, the U-shaped groove is not used as an antenna slot, but used to separate the side of the metal frame into a metal piece which is used as an antenna body.

As shown in FIG. 4, after the U-shaped groove 22 having a notch at an outer side of the metal frame is formed on a side of the metal frame 21, the U-shaped groove separates the side of the metal frame into a metal piece 23. As shown in FIG. 4, the metal piece is a piece of metal suspended separately, and there is no connection to the metal frame, so that the metal piece can be used as an antenna body without establishing an electrical connection between the metal piece and the metal frame. For example, the metal piece is connected to a feeding point network supporting a 5G network, thereby radiating a radio wave signal of a 5G frequency band and receiving a radio wave signal of a 5G frequency band through the metal piece.

In a case where a U-shaped groove is formed on a side of the metal frame, if a metal piece separated by the U-shaped groove is used as an antenna body, specific antenna type of the antenna body can also be set.

Optionally, the metal piece separated by the U-shaped groove may be ungrounded, and a feeding point is disposed on the metal piece, and the feeding point is connected to an antenna feeding network supporting the 5G network coupled to the electronic device. In this case, the metal piece is equivalent to a monopole antenna.

In the electronic device, there are fewer devices around the second sides of the metal frame. Therefore, to form grooves as antenna slots on a side of the metal frame may be: form grooves on the second sides of the metal frame. As shown in FIG. 4, a U-shaped groove 22 is formed in a second side 24 of a metal frame 21.

An antenna supporting 2G, 3G, 4G, WiFi, etc., in the electronic device is generally disposed at a top of a first side of a metal frame or a top of a metal housing, forming grooves on a second side of the metal frame can realize antennas supporting 5G on the electronic device, without affecting an antenna structure and performance of original 2G, 4G and other antennas.

In a case that grooves are formed on sides of a metal frame as antenna slots, the number of the grooves formed on the sides of the metal frame can be set as needed. For example, in a case that an antenna slot is formed on the metal cover plate, a groove as an antenna slot may be formed on the sides of the metal frame. For another example, in a case that two antenna slots are formed on the metal cover plate, two antenna slots may be formed on the sides of the metal frame.

Optionally, in a case that two or more antenna slots are formed on sides of the metal frame, any two of the two or more antenna slots formed on the sides of the metal frame are symmetric with respect to a reference point. The reference point includes one or more of a center point of the metal frame, the perpendicular bisector of a first side of the metal frame, and the perpendicular bisector of a second side of the metal frame.

For example, two grooves may be formed on a second side of the metal frame, and the two grooves may be symmetric with respect to the perpendicular bisector of the second side of the metal frame. A U-shaped groove is formed in an upper half of the second side 24 of the metal frame 21 as shown in FIG. 4, and correspondingly, a U-shaped groove can also be provided at a corresponding portion of a lower half of the second side, so that the upper half of the second side is symmetrical to the lower half.

Further, to reduce the number of antennas blocked by a user holding the electronic device, in a case that two or more antenna slots are formed on sides of the metal frame; each antenna slot is disposed adjacent to a connection area between a first side and a second side. For example, in a case that antenna slots are formed on a second side of the metal frame, the antenna slots are formed at an end of the second side or near the end, and the end is one of two ends of the second side. An antenna slot 22 on a second side 24 of a metal frame 21 as shown in FIG. 4 is disposed near a top end of the second side. Correspondingly, a distance between each antenna slot 22 on the second side 24 and the perpendicular bisector of the second side 24 is greater than a distance between the antenna slot and an end of the second side adjacent to the antenna slot.

Optionally, to further reduce a situation that antenna slots or antenna bodies separated by the antenna slots are blocked by a user holding the electronic device, at most two antenna slots are disposed on a second side of a metal frame. Correspondingly, when the number of antenna slots provided on the metal frame is three or four, the three or four antenna slots need to be distributed on two second sides of the metal frame, and each second side has up to two antenna slots.

As an alternative, in some embodiments of the present disclosure, four grooves serving as antenna slots may be formed on sides of a metal frame without forming antenna slots on a metal cover plate. In this case, a metal housing may be considered as a metal frame; or the metal housing may include a metal frame and a back cover, and the back cover may be a metal cover plate or a non-metal cover plate.

Optionally, four antenna slots that can be formed on sides of a metal frame can be distributed on two second sides of the metal frame, and two antenna slots are formed on each of the second sides. The antenna slots formed on the second sides of the metal frame may be U-shaped slots. Related description of previous embodiments can be referred to for specific function of the U-shaped slots.

Antenna slots formed on two second sides of the metal frame may be symmetric based on a reference point. The reference point may be one or more of the aforementioned perpendicular bisector of the first sides, the perpendicular bisector of the second sides, and a center of the metal frame. To reduce the situation of blocking the antenna slots, each of the antenna slots is adjacent to one of two ends of the second sides.

Figure 5:
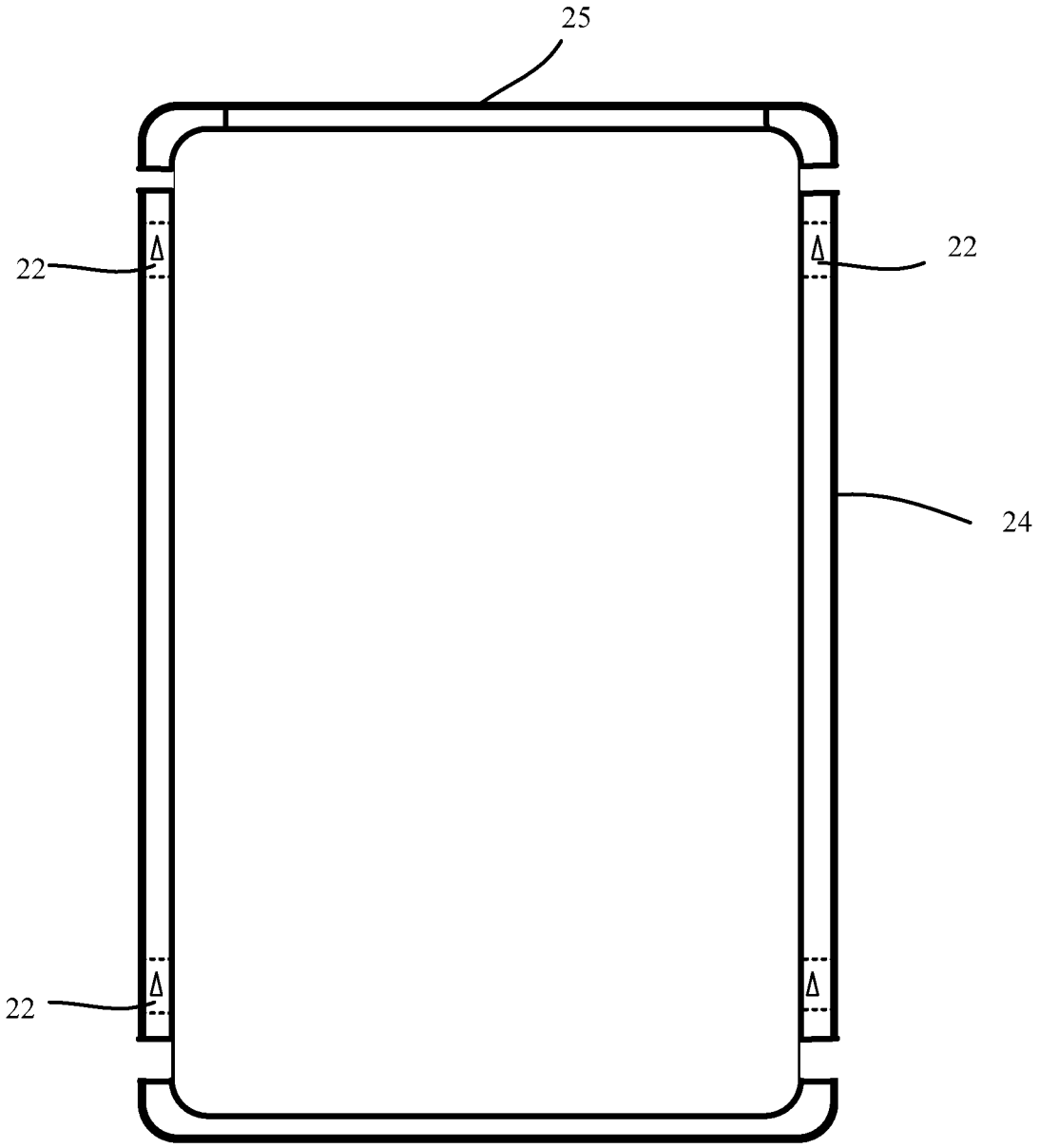
FIG. 5 is a schematic view showing positions of antenna slots provided on a metal frame of an electronic device according to some embodiments of the present disclosure.

To help understanding positional relationship of antenna slots formed on sides of the metal frame relative to the metal frame, a following example introduces a case that two antenna slots are respectively formed on two second sides of the metal frame, and a preferred positional distribution of the antenna slots on the metal frame is taken. As shown in FIG. 5, a relative positional relationship of individual antenna slots on two sides of the metal frame is shown from a back of the electronic device.

As shown in FIG. 5, two U-shaped grooves 22 are formed on each second side 24 of the metal frame (positions of the U-shaped grooves are indicated by dash line areas because a rear view cannot show specific shapes of the U-shaped grooves). For a second side, two antenna slots on the second side are distributed at two ends of the second side, and the two antenna slots are symmetric about the perpendicular bisector of the second side. Moreover, two U-shaped grooves 22 above the perpendicular bisector of the two second sides 24 are symmetrical about the perpendicular bisector of first sides 25, so as are two U-shaped grooves 22 below the perpendicular bisector of the two second sides 24. The four U-shaped grooves also have a symmetrical relationship with respect to a center point of the metal frame.

U-shaped slots are formed on the metal frame according to positions of the U-shaped slot shown in FIG. 5, so that antennas supporting the 5G network (metal pieces isolated by the U-shaped slots and antennas corresponding to antenna slots of antenna grooves) can be distributed to all around the electronic device. Therefore, the isolation of each antenna is good, the correlation is low, and the performance of the electronic device antennas can be guaranteed to be optimal in a complex practical use environment (such as a user's hand holding electronic equipment, etc.). For example, the user's hand holding the electronic device generally can block one or two of the four antennas and would not block all antennas.

Although FIG. 5 shows the positional relationship of the U-shaped grooves when the metal frame is provided with four U-shaped grooves, when less than four U-shaped grooves are arranged on the metal frame, one or more U-shaped grooves in the metal frame shown in FIG. 5 may be removed by referring to the relative positional relationship between the U-shaped grooves shown in FIG. 5. For example, if two U-shaped slots (or antenna slots of other shapes) need to be formed on one side of the metal frame, the positional relationship of two U-shaped slots formed on one second side in FIG. 5 can be kept unchanged, and the other second side is not provided with U-shaped grooves. Optionally one U-shaped groove is formed on each of the two second sides.

To adapt to an antenna body on a side of the metal frame, in some embodiments of the present disclosure, a printed circuit board can also be disposed on the side of the metal frame on which an antenna slot is formed, and the printed circuit board carries an antenna feeding network connected to an antenna corresponding to the antenna slot.

Figure 6:
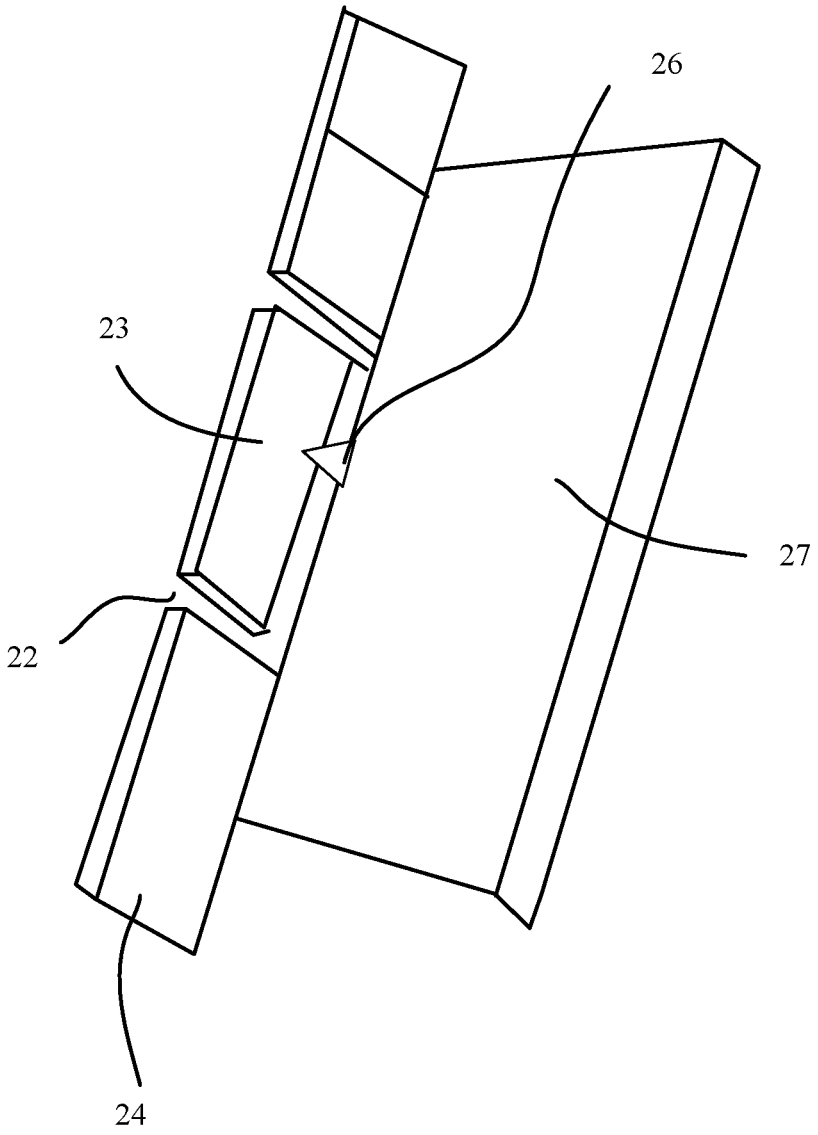
FIG. 6 is a schematic diagram showing relative positions of an antenna slot disposed on a metal frame of an electronic device, an antenna on a metal frame, and a circuit board to which the antenna on the metal frame is connected according to some embodiments of the present disclosure.

For example, in a case that a U-shaped groove is formed on a second side of the metal frame, a printed circuit board connected to an antenna corresponding to the U-shaped groove is further disposed on the second side, and the printed circuit board may be set to be perpendicular to the second side of the metal frame. Referring to FIG. 6, there is shown a schematic view of a relative position between a U-shaped groove provided on a metal frame of an electronic device, a metal piece as an antenna, and a printed circuit board connected to the antenna.

FIG. 6 shows a partial screenshot of a second side of the metal frame. As shown in FIG. 6, in a case that a U-shaped groove 22 is formed on a second side 24 of the metal frame, a feeding point 26 is provided on a metal piece 23 as an antenna which is separated out by the U-shaped groove 22. An antenna feeding circuit supporting the 5G network connected to the feeding point is on a printed circuit board 27. The printed circuit board 27 is perpendicular to the second side 24.

Optionally, the printed circuit board can be a flexible circuit board.

In some embodiments of the present disclosure, when antenna slots are formed on sides of the metal frame and the metal cover plate, four antenna slots on the sides of the metal frame and the metal cover plate are also symmetric with respect to a reference point. The four antenna slots may be configured as follows. For example, the four antenna slots are symmetric with respect to the reference point; or any two of the four antenna slots are symmetric with respect to the reference point; or two antenna slots of the four antenna slots are symmetrical with respect to a first reference point and the other two antenna slots are symmetrical with respect to a second reference point. The reference point may be one or more of a center of the metal housing, a center of the metal cover plate, the perpendicular bisector of a first side of the metal frame, and the perpendicular bisector of a second side of the metal frame.

For example, two antenna slots are formed on two second sides of the metal frame, and the two antenna slots formed on the two second sides are symmetric about the perpendicular bisector of a first side of the metal frame. Antenna slots perpendicular to second plate sides of the metal cover plate are formed on two second plate sides of the metal cover plate, and the two antenna slots on the metal cover plate are symmetrical about the perpendicular bisector of a first plate side of the metal cover plate.

In some embodiments of the present disclosure, two different types of antenna slots are provided on the metal frame and the metal cover plate as examples. In practical applications, antenna slots formed on the metal housing may have other possibilities. Correspondingly, antenna slots formed on the metal frame and the metal cover plate can be combined with other possible antenna slots formed on the metal housing to realize four antenna slots corresponding to antenna supporting the 5G network on the metal housing.

In some embodiments of the present disclosure, four antenna slots are provided on a metal housing of an electronic device, and the four antenna slots correspond to four antennas that enable the electronic device to support a fifth generation mobile communication network. By providing the four antenna slots on the metal housing, the four antennas supporting the fifth generation mobile communication network of the electronic device have a function of receiving and transmitting the fifth generation mobile communication signal, thereby enabling an electronic device with a metal housing to also have the potential to support fifth-generation mobile communication networks.

The description of the disclosed embodiments is provided to illustrate the present disclosure to those skilled in the art. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and inventive features disclosed herein.

What is claimed is:

1. An electronic device, comprising:

a metal housing including:

a metal cover plate;

a metal frame surrounding a peripheral of the metal cover plate, the metal frame including a plurality of side surfaces each perpendicular to the metal cover plate; and four antenna slots corresponding to four antennas that enable the electronic device to support a fifth generation mobile communication network, the four antenna slots being symmetrically disposed with respect to a perpendicular bisector of a side of the metal housing;

wherein the four antenna slots include U-shaped grooves each located at one of the plurality of side surfaces of the metal frame, an opening direction of each of the U-shaped grooves being perpendicular to the metal cover plate and parallel to the plurality of side surfaces of the metal frame.

2. The device according to claim 1, wherein:

the four antenna slots further include gaps located at the metal cover plate.

3. The device according to claim 2, wherein the four antenna slots are symmetrically disposed with respect to a reference point.

4. The device according to claim 3, wherein the reference point is one of a center of the metal housing, a center of one of the metal frame and the metal cover plate.

5. The device according to claim 2, wherein:

the gaps on the metal cover plate as the antenna slots are strip grooves.

6. The device according to claim 5, wherein:

the metal cover plate includes two first plate sides and two second plate sides, the first plate sides are perpendicular to the second plate sides, a length of each of the first plate sides is smaller than a length of each of the second plate sides, and the strip grooves are parallel to the first plate sides; or the strip grooves on the metal cover plate are used for radiating a signal of antennas corresponding to the strip grooves, or transmitting electromagnetic waves outside the electronic device to the antennas corresponding to the strip grooves through the strip grooves.

7. The device according to claim 1, wherein:

the U-shaped grooves separate the plurality of side surfaces of the metal frame into metal pieces of the metal frame, and the metal pieces are used as radiators of antennas supporting the fifth generation mobile communication network.

8. The device according to claim 7, wherein:

the metal pieces are not grounded, and the metal pieces are provided with feeding points, and the feeding points are connected to antenna feeding networks coupled to the electronic device to support the fifth generation mobile communication network.

9. The device according to claim 8, further comprising:

a printed circuit board carrying the antenna feeding networks;

wherein the printed circuit board is disposed on one or more side surfaces of the plurality of side surfaces of the metal frame each having one or more of the U-shaped grooves.

10. The device according to claim 1, wherein:

the plurality of side surfaces of the metal frame include two first side surfaces and two second side surfaces, the first side surfaces are perpendicular to the second side surfaces, and a length of each of the second side surfaces is longer than a length of each of the first side surfaces; and the U-shaped grooves are disposed on the second side surfaces of the metal frame.

11. The device according to claim 10, wherein:

each of the second side surfaces is provided with two of the U-shaped grooves that are respectively located at two ends of the second side surface.

12. The device according to claim 1, wherein the U-shaped grooves divide the metal frame into a metal frame body and metal pieces.

13. The device according to claim 12, wherein all sides of each of the metal pieces are spaced apart from the metal frame body.

14. The device according to claim 12, wherein a number of the U-shaped grooves equals a number of the metal pieces.

* * * * *